US006531952B1

(12) United States Patent
Meyer et al.

(10) Patent No.: US 6,531,952 B1
(45) Date of Patent: Mar. 11, 2003

(54) ROTARY POTENTIOMETER WITH PRESSURE-OPERATED SWITCH

(75) Inventors: Carsten Meyer, Waiblingen (DE); Matthias Scholz, Vaihingen/Enz (DE)

(73) Assignee: GKR Gesellschaft fur Fahrzeugklimeregelung mbH, Schweiberdingen (DE)

( * ) Notice: Subject to any disclaimer, the term of this patent is extended or adjusted under 35 U.S.C. 154(b) by 0 days.

(21) Appl. No.: 09/600,727

(22) PCT Filed: Nov. 19, 1999

(86) PCT No.: PCT/DE99/03686

§ 371 (c)(1),
(2), (4) Date: Oct. 3, 2000

(87) PCT Pub. No.: WO00/31765

PCT Pub. Date: Jun. 2, 2000

(30) Foreign Application Priority Data

Nov. 20, 1998 (DE) ..... 198 53 587

(51) Int. Cl.[7] ..... H01C 10/36; H01H 9/00
(52) U.S. Cl. ..... 338/172; 200/314
(58) Field of Search ..... 200/4, 5 R, 6 A, 200/18, 17 R, 308–317; 338/1–215

(56) References Cited

U.S. PATENT DOCUMENTS 4,363,018 A * 12/1982 Matsui et al. ..... 338/172
4,797,520 A * 1/1989 Spazierer et al. ..... 200/4
4,866,219 A * 9/1989 Riding et al. ..... 200/4
5,180,050 A * 1/1993 Rada et al. ..... 200/316
5,343,187 A * 8/1994 Shiao ..... 338/70
5,705,778 A * 1/1998 Matsui et al. ..... 200/11 R
5,847,335 A * 12/1998 Sugahara et al. ..... 200/4
5,959,267 A * 9/1999 Kawasaki et al. ..... 200/4
6,275,139 B1 * 8/2001 Shimomura et al. ..... 338/128
6,329,898 B1 * 12/2001 Mizobuchi ..... 338/162

FOREIGN PATENT DOCUMENTS

| | | |
|---|---|---|
| DE | 39 30 982 | 3/1991 |
| DE | 41 17 031 | 11/1991 |
| DE | 93 00 122 | 3/1993 |
| DE | 43 23 083 | 1/1995 |
| EP | 0 157 373 | 10/1985 |
| EP | 0 605 324 | 7/1994 |

* cited by examiner

*Primary Examiner*—J. R. Scott
(74) *Attorney, Agent, or Firm*—Kenyon & Kenyon

(57) ABSTRACT

A switching device includes a rotary potentiometer and a push button, an actuating element of the rotary potentiometer and an actuating element of the push button being concentrically arranged;

The rotary potentiometer has an essentially hollow cylindrical form in whose interior the push button is disposed.

5 Claims, 2 Drawing Sheets

ROTARY POTENTIOMETER WITH PRESSURE-OPERATED SWITCH

BACKGROUND INFORMATION

A switching device is described, for example, in the German patent No. 41 17 031. This switching device has both the function of a rotary switch and a further function, e.g., the function of a pressure-operated switch. In this switching device, disposed in the interior of a housing, standing upright on an inner base surface, is a shaft part upon which a rotary plate is supported having a wiper mounted on it. The wiper is in electrical contact with circuit patterns which are arranged on a supporting plate. The rotary motion of the shaft part causes the wiper to glide over the circuit patterns, whereby contacts can be changed. A tubular, elastic contact member is placed around the shaft part. A manually operated button is moveable around and along a bearing part of the rotary plate, so that when the button is turned, the rotary plate is turned for a switching operation of a rotary switch which is formed by the wiper and a first circuit pattern. In response to an axial movement of the button against a restoring force applied by the elastic contact member, the contact member is actuated by the button like a pressure-operated switch which is formed by a second circuit pattern and the elastic contact member.

It may be that the height of such a switching device is low, but it has a large width and depth, since the circuit patterns are arranged on a flat supporting plate perpendicular to the rotation direction of the rotary switch.

In addition, owing to the shaft arranged centrally in the housing, a central illumination of the rotary switch and of the pressure-operated switch is not possible without difficulty.

An object of the present invention is to further develop a switching device of this type to the effect that, given a compact design and simple assembly, it permits a combination of a rotary potentiometer with a pressure-operated switch, in that the pressure-operated switch is completely decoupled from the rotary potentiometer. The intention is also to permit illumination of the pressure-operated switch and/or the rotary potentiometer in a simple manner.

SUMMARY OF THE INVENTION

The embodiment of the rotary potentiometer as a hollow cylindrical form in whose interior the pressure-operated switch is arranged has the particularly great advantage that the pressure-operated switch is completely decoupled from the rotary potentiometer. In this context, in addition to the pressure-operated switch, it is advantageously possible for further elements such as light-conductive elements or even guide elements and actuating elements of the rotary potentiometer to be arranged in the interior of the rotary potentiometer. Here, the relatively large cylindrical interior space of the hollow cylindrical rotary potentiometer permits, purely in principle, the most varied arrangement possibilities of pressure-operated switches, illumination elements, guide- and/or actuating elements of the rotary potentiometer and possible further components such as switching elements, printed circuit boards, and the like.

It is also particularly advantageous that the traversing opening in the rotary potentiometer permits, purely in principle, the most varied actuating variants of the pressure-operated switch which, for example, is secured on a supporting plate arranged below the entire switching device—even at an angle.

In one advantageous specific embodiment of the present invention, the actuating element of the rotary potentiometer is hollow cylindrical and is rigidly coupled to a wiper which is displaceable on a resistor run by a rotary movement of the rotary potentiometer.

Instead of the rigid coupling, a cardanic coupling can also be provided to thus permit any angular arrangements of the actuating element on the wiper.

DETAILED DESCRIPTION

Figure 1:
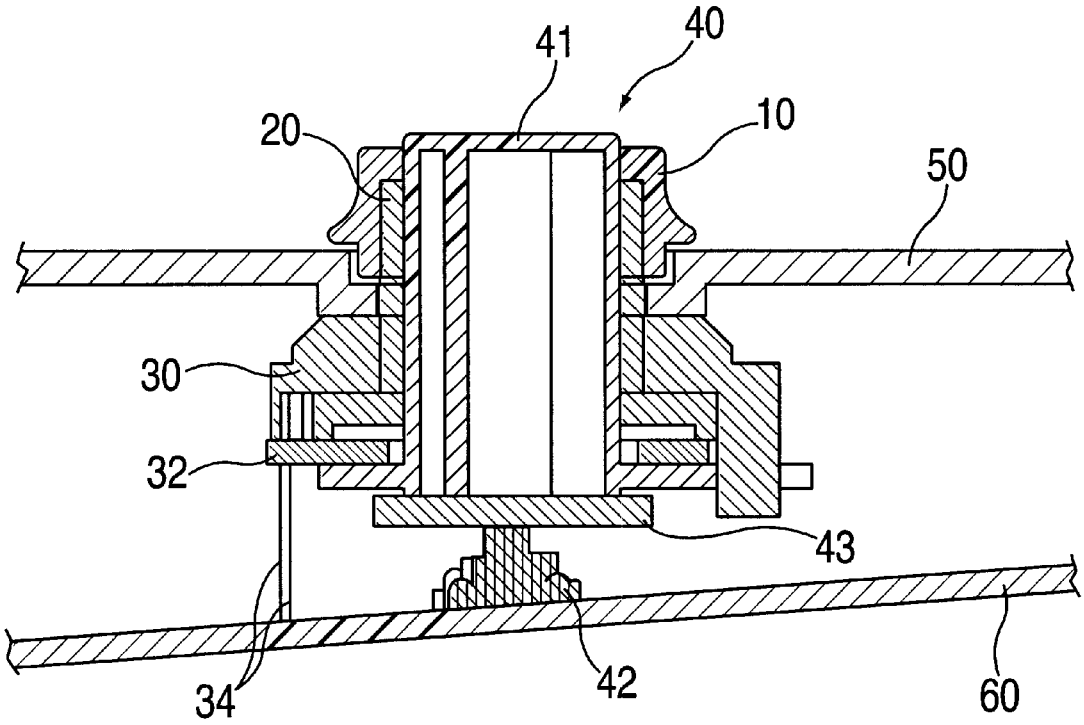
FIG. 1 shows a first specific embodiment according to the present invention.

FIG. 1, includes a rotating ring 10 which is connected in a rotatably fixed manner to a wiper 20. Wiper 20 is guided in a potentiometer guide ring 30. It glides on a potentiometer base plate 32 upon which a resistor run is disposed in a manner known per se. As FIG. 1 shows, rotating ring 10, wiper 20, potentiometer guide ring 30 and potentiometer base plate 32 have a hollow cylindrical shape with an inner, traversing, quite large opening in which a pressure-operated switch 40 is arranged. Pressure-operated switch 40 is completely decoupled from the rotating ring and wiper 20, so that rotating ring 10 and wiper 20 are rotatable without an actuating element 41 of pressure-operated switch 40 being set into a rotary motion due to this. The entire arrangement is fastened to a front baffle 50 which can be disposed at an angle to a supporting plate or printed circuit board 60, as shown in FIG. 1.

Printed circuit board 60 is connected to potentiometer base plate 32 by electrical conductors, e.g., wires 34. As FIG. 1 further shows, provision can be made on printed circuit board 60 for a switching element 42 that is operable by a lower, basically flat cover plate 43 of switch 40.

Figure 2:
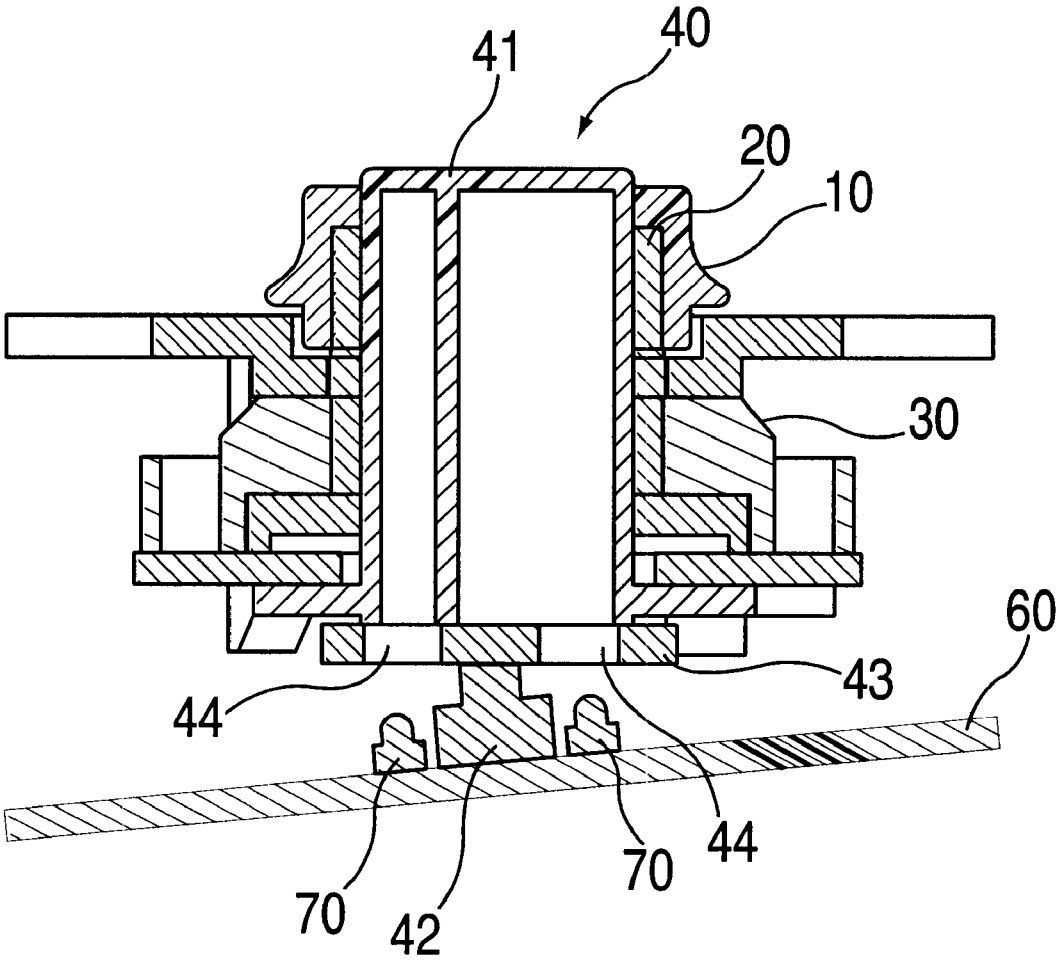
FIG. 2 shows a second specific embodiment making use of the present invention.

In a second exemplary embodiment, shown in FIG. 2, those elements which are identical to those of the first exemplary embodiment are provided with the same reference numerals, so that reference is made completely to the explanations for the first exemplary embodiment with respect to their description.

In contrast to the first exemplary embodiment, in the second exemplary embodiment, additional light-emitting diodes 70 for illuminating pressure-operated switch 40 are arranged on printed circuit board 60. Lower cover plate 43 of pressure-operated switch 40 has openings 44 through which actuating element 41 in the form of a button of pressure-operated switch 40 can be illuminated.

Inner-lying pressure-operated switch 40 is also decoupled movement-wise from the rotating ring in this specific embodiment. It is possible to compensate easily for an angular offset between the axis of the actuating elements of the combined rotary/pressure-operated switch and printed circuit board 60 here, as well.

The above-described switching device is used as an absolute-value device and pulse timer, for example, in air flow regulators of a motor-vehicle heating and air-conditioning control unit.

To this end, the switching device can be clipped into a front baffle 50, or secured in/on it in another manner. The rotating ring can be provided with a micro-catch (not shown) via a flat spring in guide ring 30 and a catch detent on the wiper.

The switching device can be contacted to printed circuit board 60 via soldering pins, or via soldered or plug-in type jumpers or the like.

With its large inside diameter, the above-described switching device offers, as a core assembly, the possibility of the structural placement and mechanical decoupling of further switching elements in its interior, for example, of electronic circuits, lighting elements and the like.

By this means, it is possible to combine logically interrelated operating functions ergonomically in one operating control element, accompanied by a compact type of construction. Due to the mechanical decoupling of the rotary- and push button functions, the push button can bear a symbol which retains its position during the rotation of the rotating ring. This markedly increases operating friendliness.

In contrast to the elements, known from the related art, which are mounted on printed circuit boards 60, the integration of the switching device into a front baffle 50 permits a simple and robust compensation of angular and position offsets between actuating element 41 and printed circuit board 60.

The switching device has a substantially larger electrical function angle than is technically feasible in the case of smaller rotary potentiometers.

In addition, the large interior space of the hollow cylindrical rotary potentiometer offers sufficient construction space to arrange several mutually independent light-conductive systems for night illumination and function illumination.

What is claimed is:

1. A switching device comprising:

a rotary potentiometer including a first actuating element on an outer periphery thereof; and a push button de-coupled from the rotary potentiometer and including a second actuating element actuatable independently of the first actuating element, wherein the first actuating element and the second actuating element are concentrically situated, and wherein the rotary potentiometer has a substantially hollow cylindrical form in whose interior the push button is situated, the interior being at last partly defined by the first actuating element.

2. The switching device according to claim 1, further comprising light-conductive elements situated in the interior of the rotary potentiometer for illuminating at least the push button.

3. The switching device according to claim 1, wherein the first actuating element is rigidly coupled to a wiper for displaceably contacting a resistance to adjust a potential of the rotary potentiometer.

4. The switching device according to claim 1, wherein at least one of the first actuating element is rigidly coupled to a wiper for displaceably contacting a resistance to adjust a potential of the rotary potentiometer.

5. The switching device according to claim 1, wherein the first actuating element is connected by a cardanic coupling to a wiper.

* * * * *

UNITED STATES PATENT AND TRADEMARK OFFICE

CERTIFICATE OF CORRECTION

PATENT NO. : 6,531,952 B1
DATED : March 11, 2003
INVENTOR(S) : Meyer et al.

It is certified that error appears in the above-identified patent and that said Letters Patent is hereby corrected as shown below:

Column 4,
Line 13, change “at last” to -- at least --.

Signed and Sealed this

Twenty-second Day of June, 2004

JON W. DUDAS
*Acting Director of the United States Patent and Trademark Office*